US008978755B2

(12) United States Patent
Sultenfuss et al.

(10) Patent No.: US 8,978,755 B2
(45) Date of Patent: Mar. 17, 2015

(54) GRAVITY DRAINAGE STARTUP USING RF AND SOLVENT

(75) Inventors: Daniel R. Sultenfuss, Houston, TX (US); Wayne Reid Dreher, Jr., College Station, TX (US); Thomas J. Wheeler, Jr., Houston, TX (US); Francis E. Parsche, Palm Bay, FL (US); Mark A. Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 802 days.

(21) Appl. No.: 13/231,781

(22) Filed: Sep. 13, 2011

(65) Prior Publication Data

US 2012/0234537 A1 Sep. 20, 2012

Related U.S. Application Data

(60) Provisional application No. 61/382,763, filed on Sep. 14, 2010, provisional application No. 61/411,333, filed on Nov. 8, 2010.

(51) Int. Cl.
*E21B 43/24* (2006.01)
*E21B 43/30* (2006.01)

(52) U.S. Cl.
CPC ..... *E21B 43/2408* (2013.01)
USPC ..... 166/247; 166/245; 166/272.6; 166/302

(58) Field of Classification Search
None
See application file for complete search history.

(56) References Cited

U.S. PATENT DOCUMENTS

| | | | | | |
|---|---|---|---|---|---|
| 3,354,958 | A | * | 11/1967 | Parker | 166/303 |
| 3,402,770 | A | * | 9/1968 | Messenger | 166/303 |
| 3,503,868 | A | * | 3/1970 | Shields | 208/429 |
| 4,004,636 | A | * | 1/1977 | Brown et al. | 166/401 |
| 4,026,358 | A | * | 5/1977 | Allen | 166/261 |
| 4,116,275 | A | | 9/1978 | Butler et al. | |
| 4,141,415 | A | * | 2/1979 | Wu et al. | 166/252.5 |
| 4,257,650 | A | * | 3/1981 | Allen | 166/272.3 |
| 4,344,485 | A | | 8/1982 | Butler | |
| 4,385,662 | A | * | 5/1983 | Mullins et al. | 166/402 |
| 4,398,602 | A | * | 8/1983 | Anderson | 166/245 |
| 4,466,485 | A | * | 8/1984 | Shu | 166/272.3 |
| 4,508,168 | A | * | 4/1985 | Heeren | 166/248 |
| 4,513,819 | A | * | 4/1985 | Islip et al. | 166/272.3 |
| 4,545,435 | A | * | 10/1985 | Bridges et al. | 166/248 |
| 5,055,180 | A | * | 10/1991 | Klaila | 208/402 |
| 5,293,936 | A | * | 3/1994 | Bridges | 166/248 |
| 6,230,814 | B1 | | 5/2001 | Nasr et al. | |

(Continued)

FOREIGN PATENT DOCUMENTS

WO PCT/US11/51427 9/2011

*Primary Examiner* — Angela M DiTrani
*Assistant Examiner* — Anuradha Ahuja
(74) *Attorney, Agent, or Firm* — Boulware & Valoir

(57) ABSTRACT

The method begins by forming a gravity drainage production well pair within a formation comprising an injection well and a production well. The pre-soaking stage begins by soaking at least one of the wellbores of the well pair with a solvent, wherein the solvent does not include water. The pre-heating stage begins by heating the soaked wellbore of the well pair to produce a vapor. The squeezing stage begins by introducing the vapor into the soaked wellbore of the well pair, and can thus overlap with the pre-heating stage. The gravity drainage production begins after the squeezing stage, once the wells are in thermal communication and the heavy oil can drain to the lower well.

26 Claims, 2 Drawing Sheets

(56) References Cited

U.S. PATENT DOCUMENTS

| | | | | |
|---|---|---|---|---|
| 6,244,341 | B1 * | 6/2001 | Miller | 166/263 |
| 6,662,872 | B2 | 12/2003 | Gutek et al. | |
| 7,562,708 | B2 | 7/2009 | Cogliandro et al. | |
| 7,770,643 | B2 * | 8/2010 | Daussin | 166/272.1 |
| 8,528,639 | B2 * | 9/2013 | Fang et al. | 166/272.3 |
| 2003/0000711 | A1 * | 1/2003 | Gutek et al. | 166/402 |
| 2005/0199386 | A1 * | 9/2005 | Kinzer | 166/248 |
| 2006/0162922 | A1 * | 7/2006 | Chung et al. | 166/245 |
| 2007/0137852 | A1 * | 6/2007 | Considine et al. | 166/60 |
| 2007/0187089 | A1 * | 8/2007 | Bridges | 166/248 |
| 2007/0261844 | A1 * | 11/2007 | Cogliandro et al. | 166/248 |
| 2008/0017372 | A1 * | 1/2008 | Gates et al. | 166/254.1 |
| 2008/0073079 | A1 * | 3/2008 | Tranquilla et al. | 166/270.1 |
| 2008/0290719 | A1 * | 11/2008 | Kaminsky et al. | 299/3 |
| 2009/0236092 | A1 * | 9/2009 | O'Brien | 166/256 |
| 2009/0255661 | A1 * | 10/2009 | Clark et al. | 166/50 |
| 2010/0071894 | A1 * | 3/2010 | Benischek et al. | 166/248 |
| 2011/0174488 | A1 * | 7/2011 | Morris et al. | 166/305.1 |

* cited by examiner

GRAVITY DRAINAGE STARTUP USING RF AND SOLVENT

CROSS-REFERENCE TO RELATED APPLICATIONS

This application claims priority to U.S. Provisional 61/382,675, filed Sep. 14, 2010, and 61/411,333, filed Nov. 8, 2010, each of which is incorporated herein in its entirety.

STATEMENT REGARDING FEDERALLY SPONSORED RESEARCH

None.

FIELD OF THE INVENTION

A method of operating a gravity drainage operation for enhanced oil recovery.

BACKGROUND OF THE INVENTION

There are extensive deposits of viscous hydrocarbons throughout the globe, including large deposits in the Northern Alberta tar sands, which are not recoverable with traditional oil well production technologies because the hydrocarbons are too viscous to flow. Indeed, the viscosity can be as high as one million centipoise. In some cases, these deposits are mined using open-pit mining techniques to extract the hydrocarbon-bearing material for later processing to extract the hydrocarbons. However, many sites are not amendable to open-pit mining techniques.

As an alternative methodology, thermal techniques can be used to heat the reservoir fluids and rock to reduce hydrocarbon viscosity and thus produce the heated, mobilized hydrocarbons from wells. One early technique for utilizing a single well for injecting heated fluids and producing hydrocarbons is described in U.S. Pat. No. 4,116,275, which also describes some of the problems associated with the production of mobilized viscous hydrocarbons from horizontal wells.

One important advance in the thermal recovery of viscous hydrocarbons is known as steam-assisted gravity drainage (SAGD) process. The SAGD process is currently the only commercial process that allows for the extraction of bitumen at depths too deep to be strip-mined. For example, the estimated amount of bitumen that is available to be extracted via SAGD constitutes approximately 80% of the 1.3 trillion barrels of bitumen in place in the Athabasca oil-sands in Alberta, Canada. Various embodiments of the SAGD process are described in CA1304287 and corresponding U.S. Pat. No. 4,344,485.

In the SAGD process, two vertically spaced horizontal wells are used to inject steam and collect the oil. Steam is pumped through an upper, horizontal injection well into a viscous hydrocarbon reservoir while the heated, mobilized hydrocarbons are produced from a lower, parallel, horizontal production well vertically spaced a few meters proximate to the injection well. Both the injection and production wells are typically located close to the bottom of the hydrocarbon deposits.

The SAGD process is believed to work as follows. The injected steam creates a "steam chamber" in the reservoir around and above the horizontal injection well. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The heated, mobilized hydrocarbons (and steam condensate) drain under the effects of gravity towards the bottom of the steam chamber, where the production well is located. The mobilized hydrocarbons are then collected and produced from the production well.

The rate of steam injection and the rate of hydrocarbon production may be modulated to control the growth of the steam chamber to ensure that the production well remains located at the bottom of the steam chamber and in a position to collect the mobilized hydrocarbons.

In order to initiate a SAGD production, thermal communication must be established between an injection and a production SAGD well pair. Initially, the steam injected into the injection well of the SAGD well pair will not have any effect on the production well until at least some thermal communication is established because the hydrocarbon deposits are so viscous and have little mobility. Accordingly, a start-up phase is required for the SAGD operation.

Typically, the start-up phase takes about three months before thermal communication is established between the SAGD well pair, depending on the formation lithology and the actual inter-well spacing. The traditional approach to starting-up the SAGD process is to simultaneously operate the injection and production wells independently of one another to circulate steam. The injection and production wells are each completed with a screened (porous) casing (or liner) and an internal tubing string extending to the end of the liner, forming an annulus between the tubing string and casing. High pressure steam is simultaneously injected through the tubing string of both the injection and production wells. Fluid is simultaneously produced from each of the injection and production wells through the annulus between the tubing string and the casing.

In effect, heated fluid is independently circulated in each of the injection and production wells during the start-up phase, heating the hydrocarbon formation around each well by thermal conduction. Independent circulation of the wells is continued until efficient thermal communication between the wells is established. In this way, an increase in the fluid transmissibility through the inter-well span between the injection and production wells is established by conductive heating.

The pre-heating stage typically takes about three to four months. Once sufficient thermal communication is established between the injection wells, the upper, injection well is dedicated to steam injection and the lower, production well is dedicated to fluid production.

A variant of SAGD is expanded solvent steam-assisted gravity drainage (ES-SAGD). In ES-SAGD a solvent is used in conjunction with steam from water. The solvent then evaporates and condenses at the same condition as the water phase. By selecting the solvent in this matter, the solvent will condense with the condensed steam, at the boundary of the steam chamber. Condensed solvent around the interface of the steam chamber dilutes the oil and in conjunction with the heat, further reduces its viscosity.

Both SAGD and ES-SAGD require the use of water to be injected down-hole. Due to costs and environmental concerns, the use of water for the production of heavy oil can be technically challenging. Furthermore, as in all thermal recovery processes, the cost of steam generation is a major part of the cost of oil production. Historically, natural gas has been used as a fuel for Canadian oil sands projects, due to the presence of large stranded gas reserves in the oil sands area, but this resource is getting more expensive and there are competing demands for the natural gas. Other sources of generating heat are under consideration, notably gasification of the heavy fractions of the produced bitumen to produce syngas, using the nearby (and massive) deposits of coal, or even building nuclear reactors to produce the heat. All of these contribute to cost.

In addition to the large operating costs of generating steam, a source of large amounts of fresh and/or brackish water and large water re-cycling facilities are required in order to create the steam for the SAGD process. Thus, lack of water and competing demands for water may also be a constraint on development of SAGD use.

Thus, what is needed in the art are improvements to oil recovery techniques that further improve cost effectiveness and/or decrease the environmental impact.

BRIEF SUMMARY OF THE DISCLOSURE

Generally speaking, the invention is a method of improving the start up efficiency of an SAGD or other steam assisted hydrocarbon production process by soaking a wellbore in solvent and vaporizing that solvent with RF energy. The vaporized solvent will increase the pressure in the wellbore, thus squeezing the formation around the wellbore, and speeding the thermal communication with the other wellbore. Once the wellbores are in thermal communication, production proceeds according to known methods.

The method begins by forming a gravity drainage production well pair within a formation comprising an injection well and a production well. The pre-soaking stage begins by soaking at least one of the wellbores of the well pair with a solvent, wherein the solvent does not include water.

The pre-heating stage begins by heating the soaked wellbore of the well pair to produce a vapor, preferably with RF energy.

The squeezing stage begins by introducing vapor (e.g., during the pre-heating stage) into the soaked wellbore of the well pair, thus increasing pressure, and the wellbore is left at this higher pressure for sufficient period of time as to allow mobilization of hydrocarbons. Thus, it can be seen that there may be some or complete overlap of the pre-heating and squeezing stages. Preferably, the RF application is halted once the solvent is vaporized in order to conserve energy, but in some embodiments, the heating may continue and the hydrocarbons or polar constituents thereof can be further heated with the applied RF energy. In yet other embodiments, additional solvent vapors can be pumped into the wellbore to further increase pressures. Combinations of the above may also be used.

Gravity drainage production begins after the squeezing stage, and can be solvent assisted gravity drainage, or steam assisted gravity drainage, or combinations or variations thereof.

In an alternate embodiment the method begins by forming a solvent vapor gravity drainage production well pair within a formation comprising an injection well and a production well. The pre-soaking stage begins by soaking at least one of the wellbores of the well pair with a solvent, wherein the solvent does not include water. The pre-heating stage begins by heating the soaked wellbore of the well pair with a radio frequency device to produce a solvent vapor. The squeezing stage begins by introducing solvent vapor into the soaked wellbore of the well pair. The solvent vapor gravity drainage production begins after the squeezing stage.

In yet another embodiment the method begins by forming a solvent vapor gravity drainage production well pair within a formation comprising an injection well and a production well, wherein the injection well is vertically spaced proximate to the production well. The pre-soaking stage begins by soaking at least one of the wellbores of the well pair with a solvent, wherein the solvent does not include water. The pre-heating stage begins by heating the soaked wellbore of the well pair with a radio frequency device optimized to heat the solvent and the connate water in the formation to produce a solvent vapor. The heating step is then stopped prior to beginning the vapor stage of introducing solvent vapor into the wellbore. The solvent vapor gravity drainage production begins after the squeezing stage.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
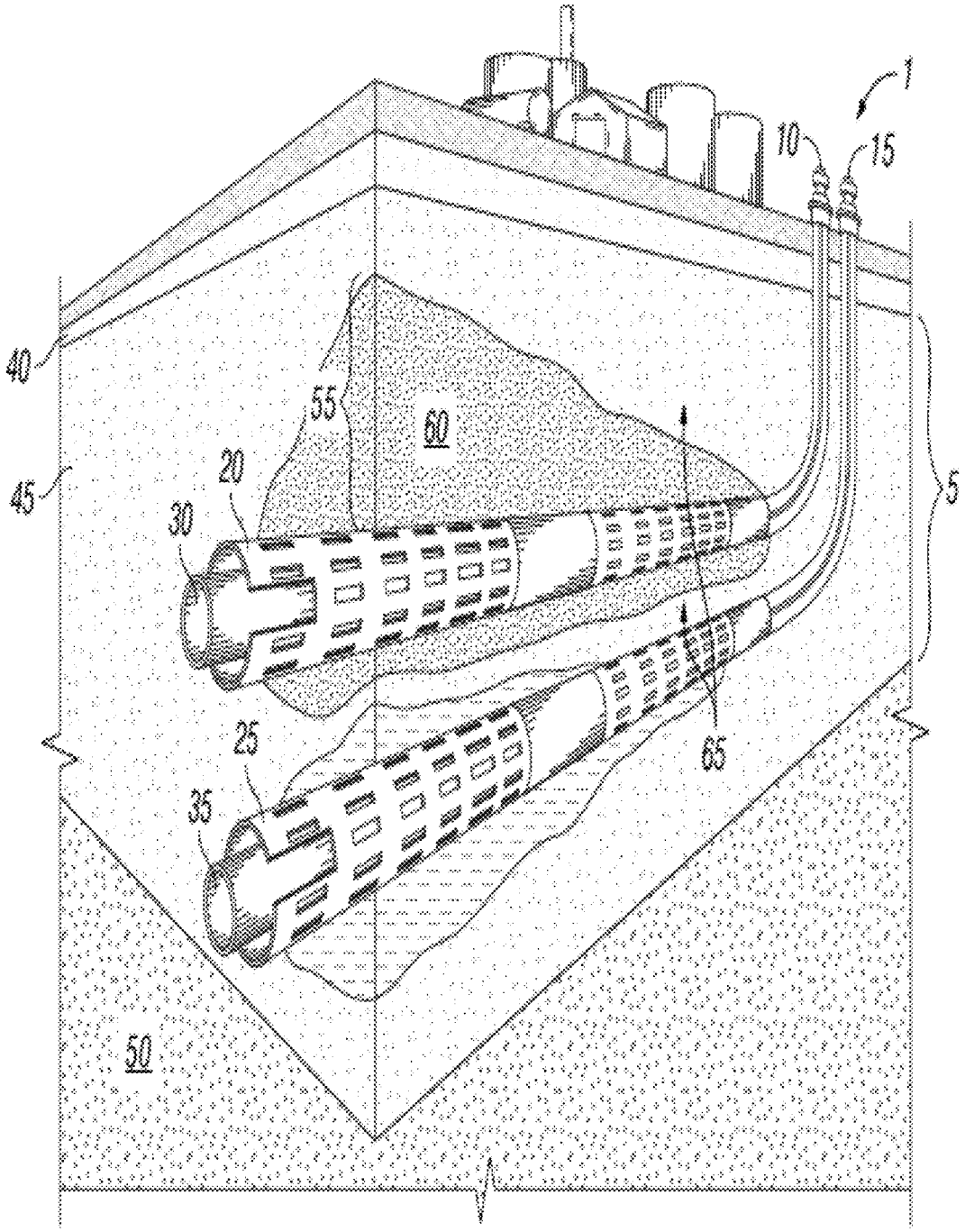
FIG. 1 is a perspective side view of a well pair for a gravity drainage operation. The placement of the RF antennae is not shown herein, but it can be placed at any suitable location, e.g., we could use the blank liners in this figure as one possible location for the RF antennae, since this is about the midpoint.

A well pair for a gravity drainage operation is shown in FIG. 1. As shown in FIG. 1, the gravity drainage operation well pair 1 is drilled into a formation 5 with one of the wells vertically spaced proximate to the other well. The injection well 10 is an upper, horizontal well, and the production well 15 is a lower, parallel, horizontal well vertically spaced proximate to the injection well 10.

In an alternate embodiment, the injection well 10 is vertically spaced about 4 to 10 meters above the production well 15. In yet another embodiment, the injection well 10 is vertically spaced about 5 to 6 meters above the production well 15. In one embodiment, the gravity drainage operation well pair 1 is located close to the bottom of the oil-sands 45 (i.e., hydrocarbon deposits). Generally, the oil-sands 45 are disposed between caprock 40 and shale 50.

The gravity drainage operation well pair 1 comprises an injection well 10 and a production well 15. The injection well 10 further comprises an injection borewell 20 and a first production tubing string 30, wherein the first production tubing string 30 is disposed within the injection borewell 20, and has a first return to surface capable of being shut-in. Similarly, the production well 15 further comprises a production borewell 25 and a second production tubing string 35, wherein the second production tubing string 35 is disposed within the production borewell 25, and has a second return to surface capable of being shut-in.

In an alternate embodiment, the injection 10 and production 15 wells are both completed with a screened (porous) casing (or liner) and an internal production tubing string 30, 35 extending to the end of the liner, and forming an annulus between the tubing string 30, 35 and wellbore (or casing) 20, 25.

During gravity drainage operation, the upper well 10 (i.e., the injection well) injects solvent vapor 60 and the lower well 15 (i.e., the production well) collects the heated, mobilized crude oil or bitumen 65 that flows out of the formation 5 along with any liquids from the condensate of the injected fluids.

In one embodiment the selection for the solvent to be used in the gravity drainage operation includes those with a dipole moment so that the solvent can be heated by radio frequencies. Exemplary solvents thus include polar solvents such as alcohols, ketones, and the like, such as isopropanol, butanol, butone, acetone, etc.

In another embodiment the selection of the solvent does not include water to appease environmental and costs concerns. An example of the types of solvent that can be used include butane, pentane, hexane, diesel and mixtures thereof. Alternatively, the RF does not necessarily have to heat the solvent, but can heat the in situ (or added) water while the solvent acts to reduce bitumen viscosity by dilution. An example of solvent vapors that can be used include air, carbon dioxide, methane, ethane, propane, natural gas and mixtures thereof.

A start-up phase is required for the gravity drainage operation. Initially, the vapor 60 injected into the injection well 10 of the gravity drainage well pair 1 will not have any effect on the production well until at least some thermal communication is established because the hydrocarbon deposits are so viscous and have little mobility. The injected solvent vapor 60 eventually form a "vapor chamber" 55 that expands vertically and laterally into the formation 5. The heat from the solvent vapor 60 reduces the viscosity of the heavy crude oil or bitumen 65, which allows it to flow down into the lower wellbore 25 (i.e., the production wellbore).

The solvent gases/vapor rise due to their relatively low density compared to the density of the heavy crude oil or bitumen 65 below. Further, gases including methane, carbon dioxide, and, possibly, some hydrogen sulfide are released from the heavy crude or bitumen, and rise in the solvent chamber 55 to fill the void left by the draining crude oil or bitumen 65.

The heated crude oil or bitumen 65 and condensed solvent flows counter to the rising gases, and drains into the production wellbore 25 by gravity forces. The crude oil or bitumen 65 and solvent is recovered to the surface by pumps such as progressive cavity pumps that are suitable for moving high-viscosity fluids with suspended solids. The solvent may be separated from the crude oil or bitumen and recycled to generate more vapor.

Figure 2:
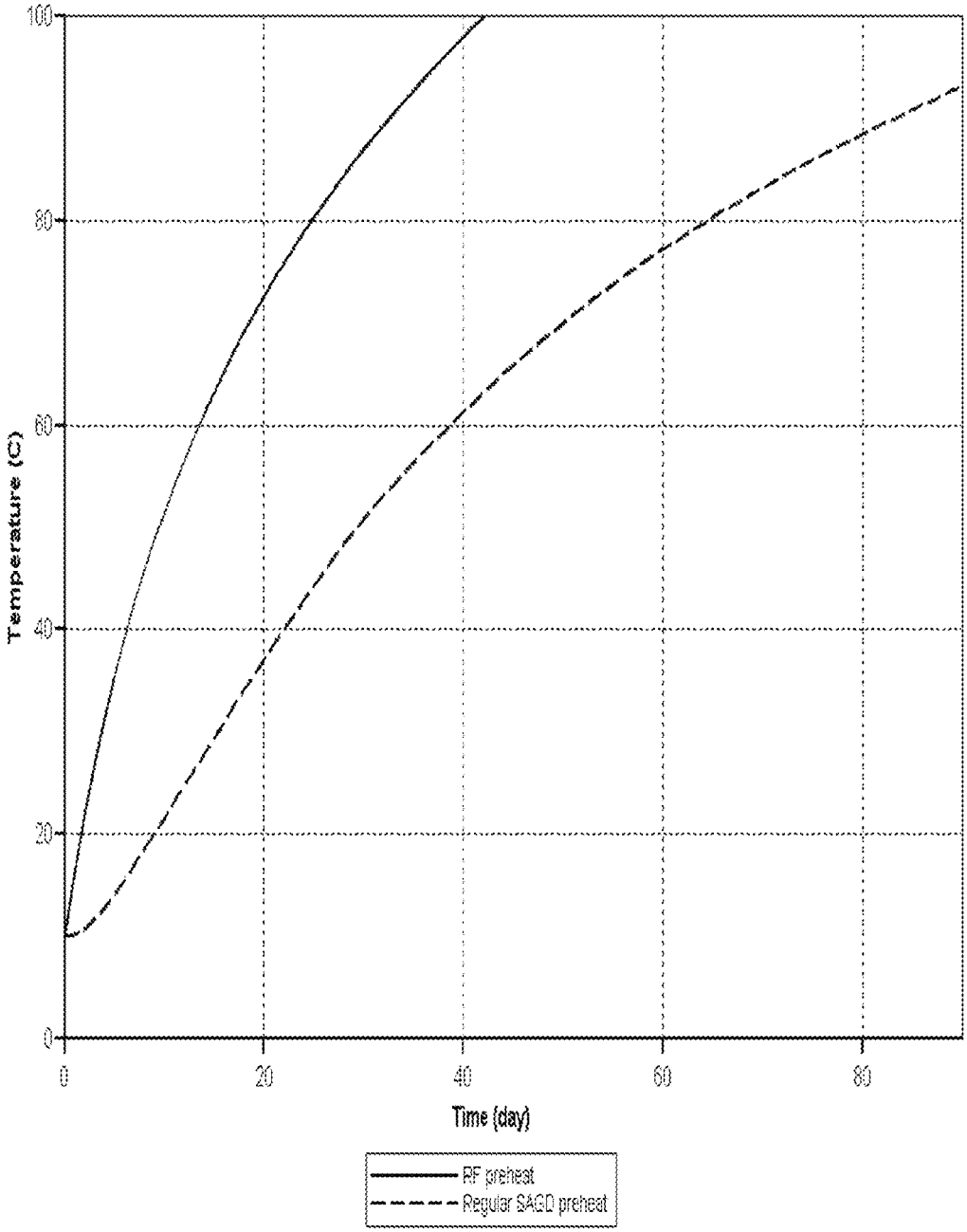
FIG. 2 is simulated plot of temperature versus time, wherein using RF reduces the time of preheat (when temperature of midpoint between the wells reaches about 90° C.) from 3 months to about 1 month. In this model, the f=20 kHz, and solvent was propane. RF is used until temperature between wells is 90° C. (~30 days), at which point pressure communication between the wells is established and the SAGD process can begin. (midpoint temperature requirement is oil and formation dependant. 90° C. is rule of thumb for Surmont, but could be higher or lower for other areas of the Athabasca.

In one embodiment, the method reduces the pre-heating time (e.g., vapor circulation time) required to establish thermal communication between an injector 10 and a producer 15 of the gravity drainage operation well pair 1. This is shown in the simulated results of FIG. 2.

In one embodiment the start-up of gravity drainage operation by quickly establishing thermal communication between an injector 10 and a producer 15 of the gravity drainage operation well pair 1 during the pre-heating stage, and, thereby, decreasing the pre-heating time required.

The method relies on both solvent and thermal benefits to reduce the viscosity of heavy crude oil or bitumen 65. The solvent benefits are provided by an initial solvent pre-soaking of the wellbores, which reduces the viscosity of the hydrocarbon deposits in the nearby of formation. The thermal benefits are provided by conductive and convective heating of formation fluids and rock between the gravity drainage operation well pair 1 through a pre-heating stage followed by short squeezing stage of solvent injection. As a result, thermal communication is established more quickly between the gravity drainage operation well pair 1 during the start-up period.

In an embodiment, a method for accelerating start-up for gravity drainage operation comprising the steps of forming a gravity drainage operation well pair 1 within a formation 5 comprising an injection well 10 and a production well 15. The injection well 10 further comprises an injection wellbore (or casing) 20; and a first production tubing string 30; wherein the first production tubing string 30 is disposed within the injection wellbore (or casing) 20, extending to an end of the wellbore 20 and forming an annulus between the tubing string 30 and the wellbore (or casing) 20, and wherein the tubing string 30 has a first return to surface capable of being shut-in.

Similarly, the production well 15 further comprises a production wellbore (or casing) 25; and a second production tubing string 35, wherein the second production tubing string 35 is disposed within the production wellbore (or casing) 25, extending to an end of the wellbore 25 and forming an annulus between the tubing string 35 and the wellbore (or casing) 25, and wherein the tubing string 35 has a second return to surface capable of being shut-in.

The method further comprises the step of beginning a pre-soaking stage by soaking one or both of the wellbores 20, 25 of the gravity drainage operation well pair 1 with a solvent. When a new gravity drainage operation well pair 1 is drilled, there are usually several months of idle/wait time before solvent and/or other facilities are available to the wells. In this embodiment the idle period can be utilized to pre-soak one or both of the wellbores 20, 25.

One or both of the wellbores 20, 25 may be pre-soaked with a liquid or a gaseous solvent that is soluble in heavy crude oil or bitumen 65. In the case of a liquid solvent, one or both of the wellbores 20, 25 are gravity fed or pumped with the liquid solvent for pre-soaking stage of a few months before gravity drainage operation start-up. The liquid solvent may be selected from the group consisting of butane, pentane, hexane, diesel and mixtures thereof.

The liquid solvent may be gravity fed or pumped through the tubing string 30, or through the annulus formed between the tubing string 30, 35 and the wellbore (or casing) 20, 25. In an embodiment, the pre-soaking stage is about 2 to 3 months. In an another embodiment, the pre-soaking stage is no more than about 4 months.

In the case of a gaseous solvent, one or both of the wellbores 20, 25 are continuously injected with a gaseous solvent for a few months before start-up. The gaseous solvent may be combined with other gases and may be selected from the group consisting of air, carbon dioxide, methane, ethane, propane, natural gas and mixtures thereof. The gaseous solvent may be injected through the tubing string 30, 35 or through the annulus formed between the tubing string 30, 35 and the wellbore (or casing) 20, 25 because the solvent does not need to be heated. In a preferred embodiment, the pre-soaking stage is about 2 to 3 months. In an especially preferred embodiment, the pre-soaking stage is no more than about 4 months.

In an embodiment, the method comprises the step of beginning a pre-heating stage by heating the wellbores 20, 25 of the gravity drainage operation well pair 1. The wellbores 20, 25 are pre-heated with a heated fluid or other heating mechanism for a few months before gravity drainage production start-up. Heating methods include electric, electromagnetic, microwave, radio frequency heating and solvent circulation, and preferably includes application of electromagnetic radiation, especially RF radiation.

In one embodiment the location of the radio frequency antenna can be placed either above ground, in the ground, and/or directed towards the solvent vapor. In one embodiment, the frequency of the radio frequency device is adjusted so that it specifically targets the heating of the solvent that is injected. In another embodiment the heating methods would heat both the connate liquids in the formation, such as water, and the added solvent.

In an embodiment, the wellbores 20, 25 may be pre-heated with solvent circulation for about 0.5 to 3 months. The pre-heating may be completed in the same manner as with a conventional gravity drainage operation start-up. In a preferred embodiment, the solvent is circulated in one or both of the wellbores (or casings) 20, 25 of an injector 10 and a producer 15 of the gravity drainage operation well pair 1. In a preferred embodiment, the pre-heating stage is about 1 to 3 months. In an especially preferred embodiment, the pre-heating stage is about one month.

In an embodiment, the method comprises the step of beginning a squeezing stage by introducing solvent vapor into the wellbores 20, 25 of the well pair 1. The wellbores 20, 25 are injected with solvent vapor for a few days to a few weeks.

In an embodiment, the pre-heating is stopped, and solvent is injected into the wellbores 20, 25. In an embodiment, the solvent vapor circulation is stopped and the returns to surface of the injection well 10 and production well 15 production tubing strings 30, 35 are shut-in to force the injected solvent vapor into the formation 5. In an another embodiment, the squeezing stage is at least 1 day. In an alternate embodiment, the squeeze stage is about 1 to 30 days.

In an embodiment, the method comprises beginning gravity drainage operation. Once efficient thermal communication is established between the gravity drainage operation well pair 1, the upper well 10 is dedicated to vapor injection, and the lower well 15 is dedicated to fluid production per the usual methods. In a preferred embodiment, the vapor injection is shut-in for the production 15 well, and the gravity drainage production well pair 1 begins gravity drainage operation, as discussed above.

Simulation studies using a numerical simulator such as CMG STARS™ (2007.10) and a 3-D reservoir model have shown that pre-soaking the wellbores with solvents for about 2 to 3 months before pre-heating (e.g., vapor circulation) the wellbores for a pre-heating stage of about one-month, and squeezing with vapor injection into the formation for about 1 to 30 days can reduce the traditional start-up phase from about 3 to 4 months to about 1 month without adversely impacting production from the gravity drainage operation well pair. See e.g., FIG. 2.

The benefit of pre-soaking with solvents before and squeezing with vapor injection after a month of pre-heating with vapor circulation is two fold: 1) the solvents reduce the viscosity of the hydrocarbon deposits, and 2) the squeezed vapor introduces convective heating, which is more efficient than conductive heating. With the benefit of solvent pre-soaking, the injected solvent can penetrate the formation fluids more quickly and establish its injected volume in the formation more efficiently. The injected vapor introduces the convection heat transfer mechanism into the formation, which promotes the thermal communication between the gravity drainage operation well pair. In one embodiment the method reduces the traditional pre-heating period by about two months, and accelerates start-up for gravity drainage operation from a gravity drainage operation well pair without adversely impacting production from the well pair.

In one embodiment of the invention the injection pressure during the solvent soaking stage is conducted within a range from 500 kPa to 6 MPa depending on the native reservoir pressure and fracture pressure of the reservoir. The injection pressure must be above the native pressure but below the fracture pressure of the overburden. In general higher pressures are favored since the solubility of the solvent in the native hydrocarbon increases with pressure and the viscosity of the hydrocarbon decreases as the dissolved solvent concentration increases. Thus higher injection pressure will provide higher hydrocarbon mobility and faster start up times.

In one embodiment of the present invention the RF pre-heating stage that follows the solvent soaking stage utilizes a RF lineal power density in the range from 0.5 kW/m to 8 kW/m of the lateral well length.

The radio frequency (RF) heating device may use a surface located active electrical current source operating at radio or microwave frequencies to couple electrical energy to one or more antennas in the hydrocarbon formation. The active electrical source may be a semiconductor device such as a ceramic metal oxide junction (CMOS) or like devices capable of transresistance.

The coupling mechanism between the radio frequency electrical source and the antenna may an open wire transmission line, a closed wire transmission line or a guided wire transmission line. The transmission line advantageously reduces transmission loss relative to unguided transmission. The guided wire transmission line may be advantageous for ease of installation with a cable tool type drilling apparatus, as will be familiar to those in the hydrocarbon arts.

The transmission line may utilize one or more of a forward wave, a reflected wave or a standing wave to convey the electrical currents. The characteristic impedance of the transmission line may be between 50 ohms and 300 ohms, although the invention is not so limited as to require operation at specific characteristic impedance. The higher impedances may reduce $I^2R$ losses in conductive materials while the lower impedances may allow smaller dielectric dimensions.

The radio frequency (RF) heating device may include an antenna to convert electrical currents into heating energies such as radio waves and microwaves. Preferred antennas include isotropic antennas, omnidirectional antennas, polar antennas, logarithmic antennas, yagi uda antennas, microstrip patches, horns, or reflectors antennas. The isotropic antenna may be used to diffuse the heating energy in a non-directional fashion. As can be appreciated by those in the art, radiated waves are created by the Fourier transform of current distributions in the antenna.

The radio frequency (RF) heating device may use radio and microwave frequencies between 100 MHz and 1000 MHz. In particular the Industrial Scientific Medical (ISM) frequencies at 902-928 MHz are identified. This spectrum may provide a useful trade between heating dissipation, penetration, and useful antenna size. In a preferred embodiment the heating energies are electromagnetic energies such as waves to heat the hydrocarbon molecules by resonance, dissipation, hysteresis, or absorption.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method of producing hydrocarbon from a subsurface formation comprising:

a) forming a gravity drainage production well pair within a formation comprising an injection well and a production well;

b) beginning a pre-soaking stage by soaking at least one of the wells of the well pair with an added solvent to generate at least one soaked well, wherein the added solvent does not include water;

c) beginning a pre-heating stage by heating said at least one soaked well with a radio frequency device, capable of emitting radio frequencies (RF), to produce a solvent vapor, wherein the radio frequencies emitted from the radio frequency device are optimized to heat the solvent;

d) beginning a squeezing stage by continuing to heat with RF until vapor pressure increases sufficiently to squeeze said at least one soaked well to introduce convection heating to the formation; and e) beginning a gravity drainage production of a hydrocarbon.

2. The method of claim 1, wherein the gravity drainage production is a solvent vapor assisted gravity drainage production.

3. The method of claim 2, wherein the injection and production wells are vertically spaced about 4 to 10 meters apart.

4. The method of claim 2, wherein the injection and production wells are vertically spaced about 5 to 6 meters apart.

5. The method of claim 1, wherein the injection and production wells are parallel, horizontal, and vertically spaced apart.

6. The method of claim 1, wherein the pre-soaking stage is no more than about 4 months.

7. The method of claim 1, wherein the pre-soaking stage is about 2 to 3 months.

8. The method of claim 1, wherein the solvent is selected from the group consisting of butane, pentane, hexane, diesel, and mixtures thereof.

9. The method of claim 1, wherein the solvent is selected from the group consisting of alcohols, ketones and mixtures thereof.

10. The method of claim 1, wherein the solvent is a gaseous solvent.

11. The method of claim 10, wherein the gaseous solvent is selected from the group consisting of air, carbon dioxide, methane, ethane, propane, natural gas and mixtures thereof.

12. The method of claim 1, wherein the pre-heating stage is about 1 to 3 months.

13. The method of claim 1, wherein the pre-heating stage is about one month.

14. The method of claim 1, wherein the squeezing stage is at least 1 day.

15. The method of claim 1, wherein the squeezing stage is about 1 to 30 days.

16. The method of claim 1, wherein said pre-soaking stage is conducted within a range from 500 kPa to 6 MPa.

17. The method of claim 1, wherein said radio frequency device comprises an isotropic antenna.

18. The method of claim 1, wherein said radio frequency device comprises a RF lineal power density in the range from 0.5 kW/m to 8 kW/m of a lateral well length.

19. The method of claim 1, wherein said radio frequency device comprises an antenna having a guided wire transmission line having an impedance between 50 ohms and 300 ohms.

20. The method of claim 1, wherein the radio frequencies are at least 20 MHz.

21. The method of claim 1, wherein the radio frequencies are between 100 MHz and 1000 MHz.

22. The method of claim 1, wherein the radio frequencies are between 902-928 MHz.

23. The method of claim 1, wherein the radio frequencies emitted from the radio frequency device are optimized to heat both the solvent and connate water in the formation.

24. A method of producing a hydrocarbon from a subsurface formation comprising:

a) forming a solvent vapor assisted gravity drainage production well pair within a subsurface formation comprising an injection well and a production well;

b) beginning a pre-soaking stage by soaking at least one of the wells of the well pair with a solvent to generate at least one soaked well, wherein the solvent does not include water;

c) beginning a pre-heating stage by heating said at least one soaked well with a radio frequency device, capable of emitting radio frequencies (RF), to produce a vapor, wherein the radio frequencies (RF) emitted from the radio frequency device are optimized to heat both the solvent and connate water in the formation to form a vapor;

d) beginning a squeezing stage by continuing to heat with RF until vapor pressure increases sufficiently to said at least one soaked well to introduce convection heating to the formation; and e) beginning a solvent vapor assisted gravity drainage production when said well pair are in thermal communication.

25. The method of claim 24, wherein additional solvent vapor is introduced into said wellbore in squeezing stage d).

26. A method comprising:

a) forming a solvent vapor assisted gravity drainage well pair within a formation comprising:

i) an injection well; and ii) a production well; and iii) wherein the injection well is vertically spaced proximate to the production well;

b) beginning a pre-soaking stage by soaking at least one of the wells of the well pair with a solvent to generate at least one soaked well, wherein the solvent does not include water;

c) beginning a pre-heating stage by heating said at least one soaked well with a radio frequency device, capable of emitting radio frequencies (RF), wherein the radio frequencies emitted from the radio frequency device are optimized to heat the solvent and connate water in the formation into a vapor;

d) stopping the heating of step (c) and continuing a squeezing stage where said at least one soaked well exists at a higher pressure as a result of vapor formation in step c); and e) beginning a solvent vapor assisted gravity drainage production.

* * * * *